US008303096B2

(12) United States Patent
Okano

(10) Patent No.: US 8,303,096 B2
(45) Date of Patent: Nov. 6, 2012

(54) LIQUID SUPPLYING APPARATUS AND IMAGE FORMING APPARATUS

(75) Inventor: Tadashi Okano, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 13/039,700

(22) Filed: Mar. 3, 2011

(65) Prior Publication Data

US 2011/0216137 A1 Sep. 8, 2011

(30) Foreign Application Priority Data

Mar. 8, 2010 (JP) ..... 2010-050708

(51) Int. Cl.
*B41J 2/175* (2006.01)

(52) U.S. Cl. ..... 347/86

(58) Field of Classification Search ..... 347/7, 19, 347/86, 87, 84, 67
See application file for complete search history.

(56) References Cited

U.S. PATENT DOCUMENTS

| | | | | |
|---|---|---|---|---|
| 5,257,044 | A * | 10/1993 | Carlotta et al. | 347/32 |
| 7,681,982 | B2 * | 3/2010 | Suzuki | 347/36 |
| 7,837,311 | B2 * | 11/2010 | Hattori et al. | 347/86 |
| 7,984,979 | B2 * | 7/2011 | Umeda | 347/85 |
| 8,192,001 | B2 * | 6/2012 | Umeda | 347/86 |
| 2008/0180496 | A1 * | 7/2008 | Hattori et al. | 347/86 |
| 2009/0039002 | A1 | 2/2009 | Umeda | |
| 2009/0141095 | A1 * | 6/2009 | Umeda | 347/85 |
| 2009/0256895 | A1 * | 10/2009 | Hattori et al. | 347/86 |
| 2011/0310197 | A1 * | 12/2011 | Yazawa | 347/86 |

FOREIGN PATENT DOCUMENTS

| | | |
|---|---|---|
| JP | 6-86035 | 3/1994 |
| JP | 2007-69541 | 3/2007 |
| JP | 2008-119969 | 5/2008 |
| JP | 2009-39870 | 2/2009 |
| JP | 2009-83290 | 4/2009 |

* cited by examiner

*Primary Examiner* — Dameon Levi
*Assistant Examiner* — Patrick King
(74) *Attorney, Agent, or Firm* — Cooper & Dunham LLP

(57) ABSTRACT

Disclosed is a liquid supplying apparatus including an ink cartridge, a sub-tank, nozzles, and an ink cartridge installation part. The ink cartridge has a first ink container and a second ink container. The first ink container has a holding member that has its position lowered. The second ink container has an operating member, a biasing unit, and a locking unit. The locking unit engages the operating member until the remaining amount of the ink is below a prescribed value and the holding member engages the locking unit. The locking unit releases engagement of the operating member when the remaining amount of ink is below the prescribed value and the holding member engages the locking unit. The operating member protrudes from the ink cartridge installation part and is opened to the position allowing the operation on the ink cartridge when the engagement with the locking unit is released.

8 Claims, 15 Drawing Sheets

LIQUID SUPPLYING APPARATUS AND IMAGE FORMING APPARATUS

BACKGROUND OF THE INVENTION

1. Field of the Invention

The present invention relates to a liquid supplying apparatus and an image forming apparatus and, more specifically, to a mechanism for identifying a cartridge needing to be replaced when the remaining amount of ink is below a prescribed value.

2. Description of the Related Art

As is generally known, printers, facsimile machines, copiers, and image forming apparatuses having plural such functions are configured to use a liquid droplet ejection apparatus having a recording head composed of a liquid ejection head that ejects liquid droplets such as ink.

The liquid droplet ejection apparatus attaches liquid droplets ejected from the recording head to a recording medium such as a recording sheet or causes the liquid droplets to permeate into the recording medium to form an image.

Note that examples of the recording medium include, besides the recording sheet described above, materials such as fibers including threads, leather, metal, resin, glass, wood, and ceramic allowing the attachment or permeation of liquid.

The liquid droplet ejection apparatus is provided with a liquid supplying apparatus that supplies ink from an ink cartridge acting as a main tank to a sub-tank provided in a carriage equipped with the recording head via a supplying tube or the like.

In order to allow image formation with plural colors, the liquid supplying apparatus may have plural of the ink cartridges provided corresponding to the plural colors.

Meanwhile, an ink cartridge is a member needing to be replaced when the remaining amount of the ink stored in the ink cartridge is below a prescribed value.

Up until now, the following method has been known as a method for identifying an ink cartridge needing to be replaced among those provided in a liquid supplying apparatus.

Assuming that an ink jet printer is an on-demand type that is used while being connected to a personal computer or the like, when the remaining amount of ink in any of plural ink cartridges is detected to be zero, information on the empty state of the corresponding ink cartridge is displayed on the display of the personal computer acting as an image information output unit connected to the color ink jet printer.

After confirming the display of the personal computer, a user leaves his/her desk to access the ink jet printer, opens the cover of the ink jet printer, and removes the ink cartridge of the color concerned among those arranged side by side so as to be replaced.

At this time, if the user does not exactly remember the color of the empty ink cartridge displayed on the personal computer, he or she may erroneously remove another of the ink cartridges.

In order to prevent this problem, it is possible to provide a light source near the installation position of ink cartridges of a printer main body so that the user is alerted to replace any of the ink cartridges when confirming the lighting or blinking of the light source.

However, since the user may not fully understand what the lighting or blinking of the light source indicates, i.e., the user may not fully understand whether the ink cartridges have become empty or still contain sufficient amounts of ink with this configuration of the ink jet printer, he/she may remove one of the other ink cartridges.

In order to solve such a problem in the replacement of an ink cartridge, Patent Document 1, for example, has proposed a printer that automatically unloads an empty ink cartridge and then loads a new ink cartridge provided by a user into a carriage with an automatic loading mechanism.

In this case, however, since the automatic loading mechanism must be specially provided inside the printer, the printer suffers from its complicated structure and high cost.

In addition, the connection joint of the ink cartridge and the connection joint of a printer main body are separated from each other in the printer. Therefore, the leakage of ink, the mixing of air bubbles or dust into an ink supplying path if a user does not immediately replace the ink cartridge, and a problem in an ink supply function due to the ink being dried may be caused.

In order to solve such problems, Patent Document 2, for example, has proposed an ink cartridge the joint of which is not separated from the joint of a printer main body, the ink cartridge being configured to have its outer shape deformed with a unit that operates an actuator or the like when the remaining amount of ink is detected to be zero so that a user is allowed to visually check the ink cartridge to be removed.

On the other hand, Patent Document 3, for example, has proposed an ink container configured such that a main chamber and a sub-chamber having a bellows are connected to each other via a branch flow path, the constriction operation of the bellows is induced by the outflow of ink from the sub-chamber when ink inside the main chamber decreases with the outflow of the ink from the main chamber, and engagement with the holding part of a cartridge is released via a member that operates simultaneously with the constriction operation of the bellows, whereby the cartridge can be unlocked by a member that decreases its volume with the consumption of the ink and be replaced.

The ink cartridge disclosed in Patent Document 2 allows the user to visually check the cartridge needing to be replaced but requires the actuator or the like to check the cartridge. Therefore, since the ink cartridge requires, as in the printer disclosed in Patent Document 1, a detection unit that detects whether the ink cartridge has become empty and an operations unit such as a special actuator acting as a trigger for detecting the empty state of the ink cartridge and deforming the outer shape of the ink cartridge, problems in the complicated structure of the mechanism of the ink cartridge and high cost are not still solved.

Further, the ink container disclosed in Patent Document 3 uses the member that decreases its volume with the consumption of the ink to unlock and replace the cartridge, which in turn eliminates the use of a mechanical component such as the actuator or the like disclosed in Patent Document 2. Therefore, reduction in component cost can be attained.

However, the ink container disclosed in Patent Document 3 is configured to, as the ink outflows from the sub-chamber with the consumption of the ink, move a locking release member in accordance with a change in the constriction operation of the bellows forming the sub-chamber to release engagement with a locking member, and configured to bias the cartridge to be ejected outside when the cartridge is unlocked. Therefore, the ink cartridge is configured to be locked during its ejection process when the locking member faces the engagement part of the bellows again. As a result, the ejection of the cartridge may be interrupted.

Moreover, after the release of the engagement, the cartridge itself must be ejected. Thus, although a force for biasing the cartridge to be ejected is substantially large, the upsizing and complexity of an apparatus due to the provision of a biasing force application unit are inevitable.

Further, the ejected cartridge may take outside air or foreign matter into it because the bellows of the sub-chamber cannot maintain a constriction position due to its shape restoration force. If the outside air or the foreign matter is taken into the ejected cartridge, there is a problem in the reuse of the cartridge and the ink container is disadvantageous in terms of environmental protection.

Patent Document 1: JP-A-2007-69541
Patent Document 2: JP-A-2009-39870
Patent Document 3: JP-A-2009-83290

SUMMARY OF THE INVENTION

The present invention has been made in view of the above problems in the conventional liquid droplet ejection apparatuses, in particular, the problem in the replacement of the cartridge, and may have an object of providing a liquid droplet supplying apparatus having a configuration that allows a user to easily perform visual identification without using an additional structure such as a special configuration or the like while preventing the leakage of ink and the intrusion of air bubbles or foreign matter into an ink supplying path and also providing an image forming apparatus.

According to an embodiment of the present invention, there is provided a liquid supplying apparatus including a replaceable ink cartridge used as a main tank storing ink as a recording liquid; a sub-tank to which the ink cartridge is connected via a supplying path and the ink inside the ink cartridge is supplied; nozzles from which the recording liquid stored in the sub-tank is ejected; and an ink cartridge installation part detachably accommodating the ink cartridge. The ink cartridge has a first ink container that stores the ink and freely increases and decreases a volume thereof in accordance with a storing amount of the ink and a second ink container enclosing the first ink container. The first ink container has a holding member that has a position thereof lowered in accordance with a remaining amount of the ink. The second ink container has an ink cartridge replacement operating member capable of being opened in a direction so as to outwardly protrude from a position adjacent to a side wall of the second ink container to a position allowing an operation on the ink cartridge from an outside of the ink cartridge installation part, a biasing unit that biases the operating member in the direction where the operating member is opened, and a locking unit that is provided at the side wall of the second ink container and fixes the operating member at the position adjacent to the side wall of the second ink container against the biasing unit. The locking unit engages the operating member until the remaining amount of the ink inside the first ink container is below a prescribed value and the holding member engages the locking unit. The locking unit releases engagement of the operating member when the remaining amount of the ink inside the first ink container is below the prescribed value and the holding member engages the locking unit. The operating member protrudes from the ink cartridge installation part and is opened to the position allowing the operation on the ink cartridge from the outside when the engagement with the locking unit is released.

Other objects, features and advantages of the present invention will become more apparent from the following detailed description when read in conjunction with the accompanying drawings.

DETAILED DESCRIPTION OF THE PREFERRED EMBODIMENTS

Next, referring to the accompanying drawings, a description is made of the best mode for carrying out the embodiments of the present invention.

Figure 1:
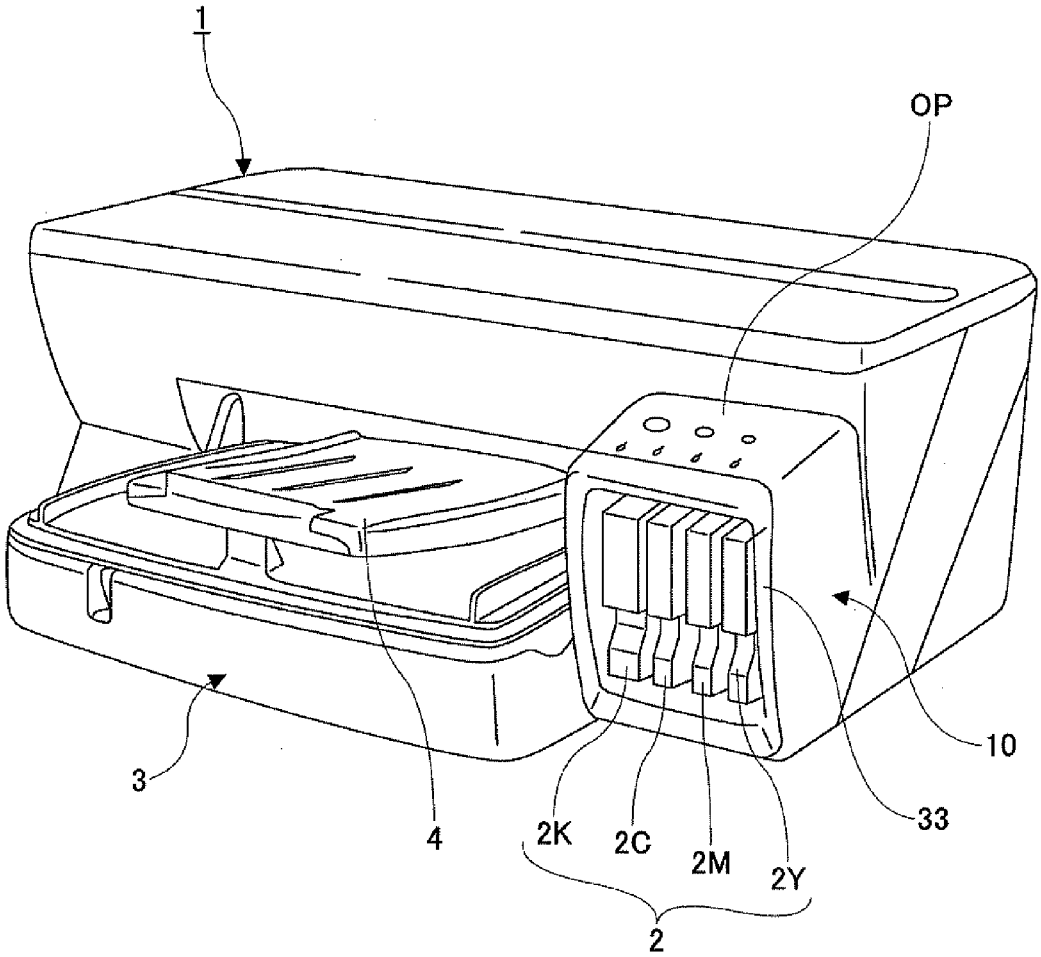
FIG. 1 is an external view of an image forming apparatus using a liquid droplet ejection apparatus according to the embodiments of the present invention.

FIG. 1 is an external view of an ink jet printer 1 acting as an image forming apparatus using a liquid droplet ejection apparatus according to the embodiments of the present invention.

The ink jet printer 1 shown in FIG. 1 has, at the lower right part of its front surface, an ink cartridge installation part 10 in which replaceable ink cartridges 2K, 2C, 2M, and 2Y (hereinafter denoted by numeral 2 for convenience sake as occasion demands) storing different colors of ink can be installed. At the front surface of the ink cartridge installation part 10, opening/closing covers 33 capable of covering the front surfaces of the respective ink cartridges may be attached. Note that in FIG. 1, the opening/closing cover 33 positioned at the front surfaces of the respective ink cartridges are collectively denoted by numeral 33. Note that in FIG. 1, numeral OP denotes an operations panel.

A user can replace an empty ink cartridge 2 on the side of the front surface of the ink jet printer 1. Further, the ink jet printer 1 has a sheet feeding tray 3 at its lower part, so that the user can replenish print media 12 such as sheets.

Moreover, a sheet ejection tray 4 is provided on the sheet feeding tray 3, so that the user can remove printed sheets.

As described above, since the ink jet printer 1 is configured to allow the replenishment of ink and sheets and the removal of printed sheets on the side of the front surface of an apparatus main body, it is possible for the user to install the ink jet printer 1 in a small space such as a shelf and a desk. Moreover, it is also possible for the user to adjacently place other objects on the right and left sides of the ink jet printer 1 and install the ink jet printer 1 along the corner of walls in an office or the like. Therefore, even if the ink jet printer 1 is installed in a narrow space, the user can satisfactorily operate the ink jet printer 1.

Figure 2:
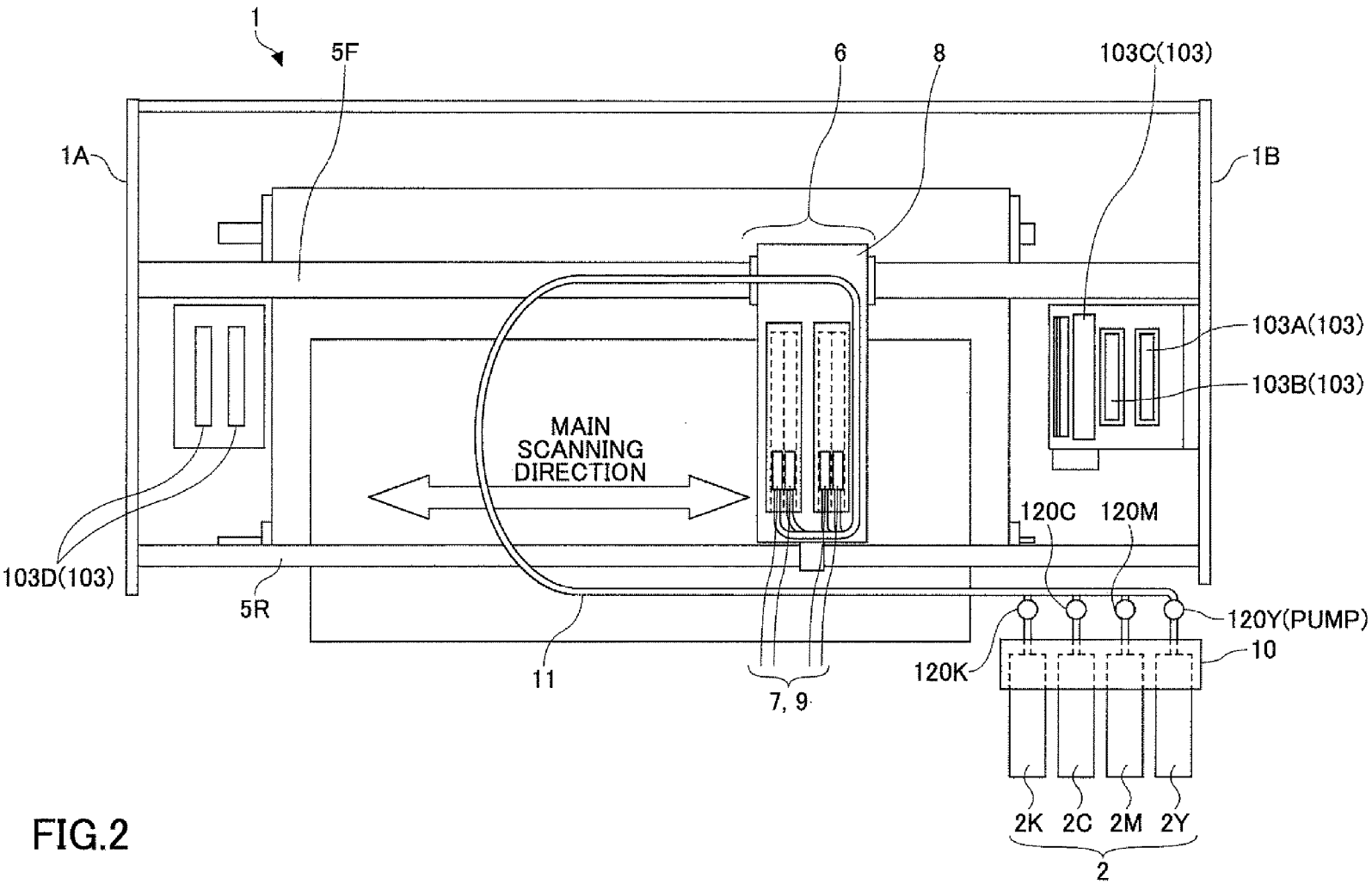
FIG. 2 is a plan view showing the main configuration of a liquid droplet ejection mechanism used in the image forming apparatus shown in FIG. 1.

FIG. 2 is a schematic plan view showing the main part of a liquid droplet supplying apparatus. As shown in FIG. 2, in the ink jet printer 1, a pair of guide rods 5R and 5F bridged across opposing right and left side plates 1A and 1B is provided, and an image forming unit 6 is slidably supported on the guide rods 5R and 5F.

The image forming unit 6 has a carriage 8 acting as a casing in which an ink jet recording head 7 is installed, and two sub-tanks 9 capable of storing the ink are provided in the carriage 8. The carriage 8 is united with a timing belt (not shown) and provided in parallel to the longitudinal direction of the guide rods 5F and 5R. The carriage 8 receives a translational force through a pulley or the like from a driving source such as a motor (not shown) and is configured to reciprocate along the guide rods 5F and 5R with the normal and reverse rotations of the motor.

Meanwhile, as shown in FIGS. 1 and 2, the ink cartridge installation part 10 is provided on the right and front side of the ink jet printer 1. In the ink cartridge installation part 10, the four ink cartridges 2Y, 2M, 2C, and 2K storing the four colors of ink for forming a color image are detachably, i.e., replaceably installed.

The four colors of ink cartridges 2 correspond to main tanks storing the ink and are each connected to the corresponding sub-tank 9 on the carriage 8 via an ink supplying tube 11. Four supplying pumps 120Y, 120M, 120C, and 120 K, respectively supply the ink from the ink cartridges 2Y, 2M, 2C, and 2K to the corresponding colors of the sub-tanks 9. The supplying pumps 120Y, 120M, 120C, and 120K may be piston pumps, or may be rotary pumps capable of supplying the ink from the ink cartridges 2 to the sub-tanks 9 at normal rotation and capable of reversely supplying the ink from the sub-tanks 9 to the ink cartridges 2 at reverse rotation.

Note that in FIG. 2, numeral 103 denotes a maintenance and restoration mechanism provided in a non-print region on one side of the carriage 8 in a scanning direction. The maintenance and restoration mechanism 103 is a mechanism that restores the meniscuses of the ink in the nozzles of the ink jet recording head 7 and eliminates foreign matter or the like from the nozzles to restore the function of the nozzles. For this purpose, the maintenance and restoration mechanism 103 has cap members 103A and 103B that cap the nozzle surfaces of the ink jet recording head 7; a wiper blade 103C acting as a blade member that wipes off the nozzles surfaces; idle ejection receivers 103 that receive liquid droplets ejected when the idle ejection of the liquid droplets irrelevant to recording is performed to eject thickened ink; and the like.

Figure 3:
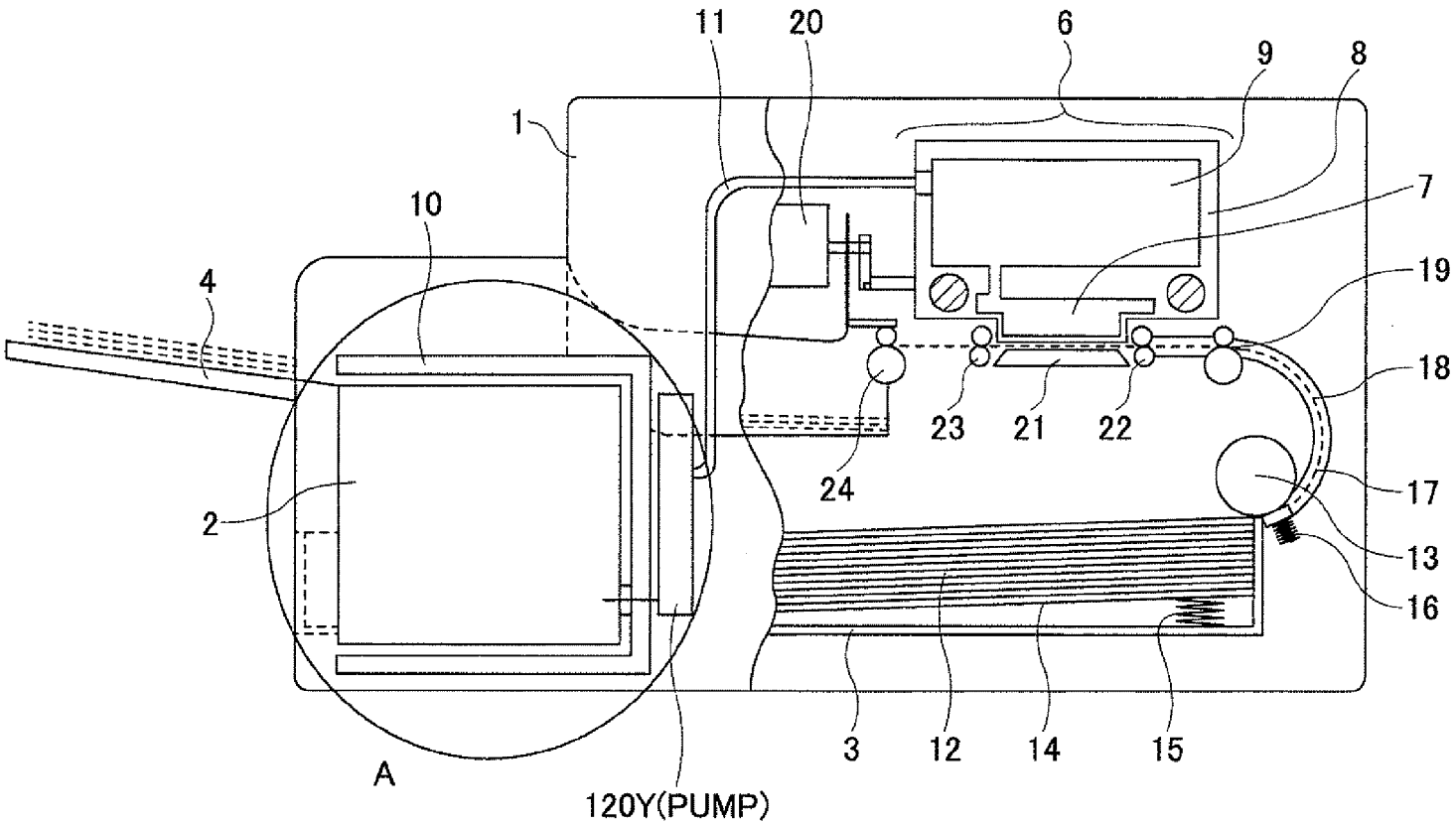
FIG. 3 is a side schematic view for explaining the configuration of a liquid droplet supplying part used in the main configuration shown in FIG. 2.

FIG. 3 is a side schematic view of the ink jet printer 1. As shown in FIG. 3, the ink jet printer 1 has the sheet feeding tray 3 detachably provided at the lower part, so that the user can load a batch of recording sheets such as the print media 12 in the sheet feeding tray 3. When the sheet feeding tray 3 is extracted from the ink jet printer 1, the user is allowed to perform the replenishment of the sheets.

At the tip end of the sheet feeding tray 3 in a sheet feeding direction, a sheet feeding roller 13 is provided. Further, the sheet feeding tray 3 has a bottom plate 14 beneath the batch of sheets to load the sheets thereon and has a sheet pressing and biasing unit 15 that presses and biases the batch of sheets to the sheet feeding roller 13.

When the sheets are extracted from the batch of sheets of the sheet feeding tray 3 with the rotation of the sheet feeding roller 13, the sheets are separated one by one in cooperation with a separation member 16 and fed to the inside of the apparatus. The single sheet thus separated is conveyed by a first conveyance roller 18 provided along a U-turn conveyance path 17 and fed into an image forming part via a second conveyance roller 19.

In the image forming part, the carriage 8 having the ink jet recording head 7 is provided and caused to reciprocate in a main scanning direction (in a direction perpendicular to space in FIG. 1) by a main scanning motor 20 acting as a power source.

Further, at a cutaway part on the left side of the ink jet printer 1 in FIG. 3, the ink cartridge 2 is provided. The ink supplied by the supplying pumps 120 from the ink cartridges 2 to the sub-tanks 9 on the carriage 8 via the ink supplying tube 11 is temporarily stored in the sub-tanks 9 and then supplied to the ink jet recording head 7.

The ink supplied to the sub-tanks 9 is ejected from the ink jet recording head 7 as minute ink droplets while the carriage 8 reciprocates and is shot onto the sheet conveyed on a platen 21 to perform printing.

A pair of tip end pressure rollers 22 is provided on the upstream side of the platen 21 in the sheet conveyance direction, and a pair of spurring rollers 23 is provided on the downstream side thereof. The paired tip end pressure rollers 22 and the paired spurring rollers 23 maintain the planar state of the sheet being printed, and maintain a constant distance between the ink jet recording head 7 and the sheet in cooperation with the platen 21. Thus, an image is satisfactorily formed without causing a liquid-droplet shooting error. Then, the sheet is conveyed by a sheet ejection roller 24 and ejected onto the sheet ejection tray 4.

Meanwhile, the ink cartridges 2 are installed in the ink cartridge installation part 10. In other words, the four ink cartridges 2Y, 2M, 2C, and 2K storing the four colors of ink for forming a color image are detachably installed in the ink cartridge installation part 10, and are replaceable when the remaining amount of the ink inside the ink cartridges becomes zero.

Next, based on the above configuration of the liquid supplying apparatus, a description is made of a mechanism for identifying the ink cartridge when the remaining amount of the ink becomes zero.

Figure 4A:
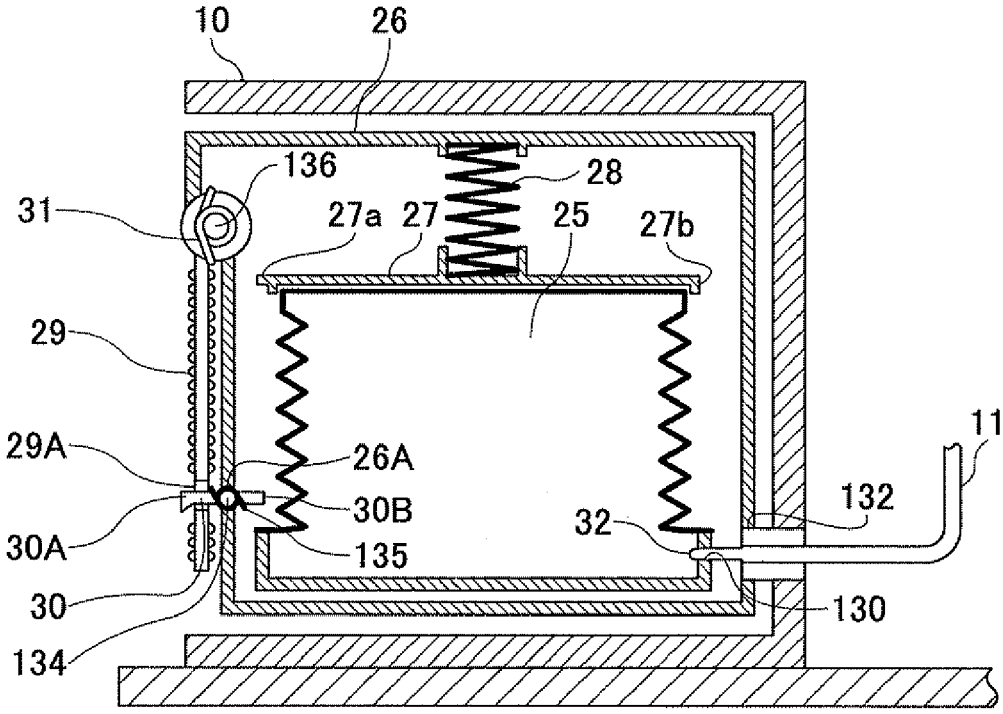
FIGS. 4A and 4B are views for explaining the configuration of first and second ink containers used in the liquid droplet ejection apparatus according to a first embodiment of the present invention.
Figure 4B:
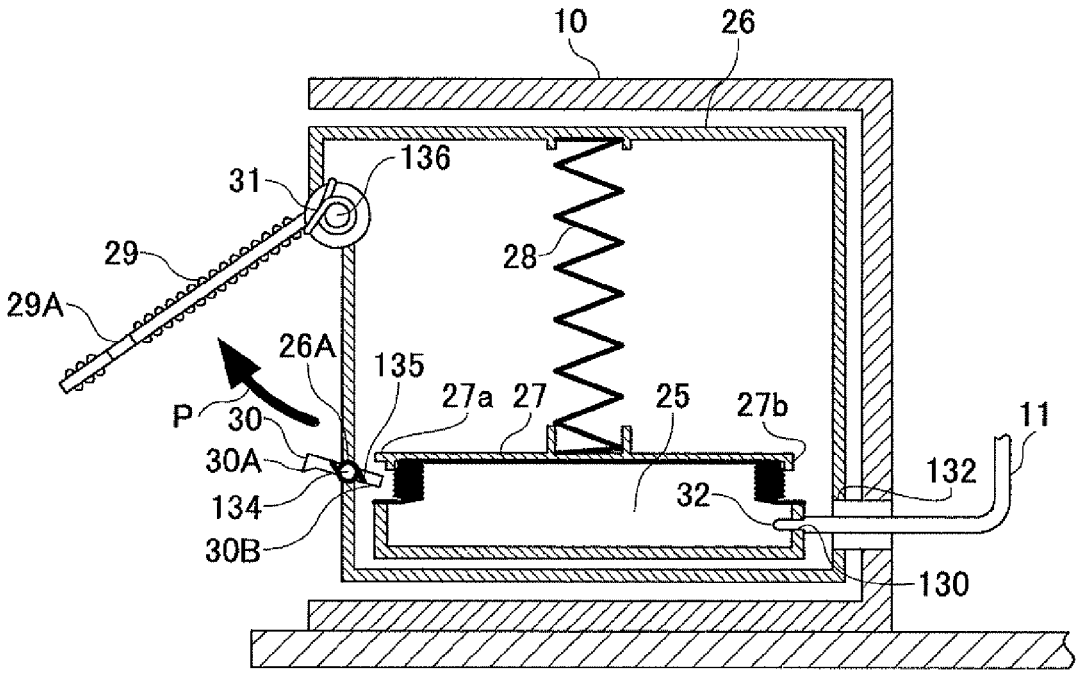

FIGS. 4A and 4B are views showing a first embodiment of the liquid supplying apparatus in the present invention. In FIGS. 4A and 4B, the inside of the ink cartridge 2 used in the liquid supplying apparatus is shown in an enlarged view. Note that the other ink cartridges storing the respective colors of ink have the same configuration.

The ink cartridge 2 is composed of a first ink container 25 that contains the ink and freely increases and decreases its volume in accordance with the contained amount of the ink and composed of a second ink container 26 that encloses the first ink container 25 and defines the contour of the ink cartridge 2.

The first ink container 25 has a holding member 27 integrated at its upper surface, and a biasing member 28 using a coil spring is arranged between the holding member 27 and the inside of the ceiling plane of the ink container 26.

When being biased by the biasing member 28, the first ink container 25 can be displaced in such a manner as to decrease its volume with the decrease of the remaining amount of the ink. The supplying tube 11 has a needle 32 at its tip end. The ink cartridge 2 has a first supplying port 130 and a second supplying port 132 provided at positions where the first supplying port 130 and the second supplying port 132 correspond to the needle 32 when the ink cartridge 2 is installed in the ink cartridge installation part 10. When the ink cartridge 2 is installed in the ink cartridge installation part 10, the needle 32 penetrates the first supplying port 130 and the second supplying port 132 of the ink cartridge 2 and is inserted into the first ink container 25. The first supplying port 130 is provided at the first ink container 25, and the second supplying port 132 is provided at the second ink container 26.

Meanwhile, the second ink container 26 is a casing-shaped member having space where the first ink container 25 can be enclosed, and has an operating member 29 and a locking member 30 at a wall surface forming the contour.

At the side wall of the second ink container 26, the locking unit 30 is provided at a position corresponding to a state where the remaining amount of the ink is below a prescribed value when the volume decreases with the consumption of the ink. The locking unit 30 is composed of an engagement claw (the locking unit 30 is hereinafter referred to as the engagement claw 30 for convenience sake) that is configured to engage the holding member 27 when the holding member 27 of the first ink container 25 is lowered to the position corresponding to the state where the remaining amount of the ink is below the prescribed value. The locking unit 30 has an end part 30B extending to the side of the holding member 27 and an end part 30A extending to the side of the operating member 29 via its turning support 134.

The engagement claw 30 is provided with a biasing unit 135 that generally applies to the engagement claw 30 torque in a counterclockwise direction in FIGS. 4A and 4B. The rotation of the engagement claw 30 due to the torque is restricted by the part of the lower surface of a slit 26A formed in the second ink container 26.

Where the movement of the engagement claw 30 is restricted by the lower edge of the slit 26A formed in the second ink container 26, the end part 30B protrudes in such a manner as to interfere with the movement of the holding member 27 of the first ink container 25 and the end part 30A engages an engagement hole 29A formed in the operating member 29 of the second ink container 26 as shown in FIG. 4A.

As shown in FIGS. 4A and 4B, the operating member 29 forming a part of the contour of the second ink container 26 is swingablly supported on the second ink container 26 with its upper end part as a swing support point 136.

An operating biasing unit 31 such as a torsion coil spring attached to the swing support point 136 presses the operating member 29 so as to be moved from a position where the operating member 29 is near the side wall of the second ink container 26 and forms a part of the contour of the second ink container 26 to a position where the operating member 29 protrudes from the ink cartridge installation part 10 so that the user can operate on (service) the ink cartridge 2 from the outside.

In the first ink container 25 and the second ink container 26 thus configured, the engagement of the engagement claw 30 with the first ink container 25 is not released by the holding member 27 unless the remaining amount of the ink inside the first ink container 25 is below a prescribed value. Therefore, as shown in FIG. 4A, the operating member 29 is closed and brought into contact with the side wall of the second ink container 26 to form a part of the contour thereof. The state where the operating member 29 engages the engagement claw 30 is maintained.

On the other hand, when the first ink container 25 is displaced in such a manner as to decrease its volume with the consumption of the ink inside the ink cartridge 2 and the remaining amount of the ink is below a prescribed value, an operating part 27*a* of the holding member 27 contacts the end part 30B of the engagement claw 30. As a result, since the engagement claw 30 is swung and turned about the turning support point 134, engagement with the operating member 29 is released. The operating member 29 is pressed toward the outside of the ink cartridge installation part 10 by the operating biasing unit 31. That is, as indicated by arrow P in FIG. 4B, the operating member 29 is rotated from the position where the operating member 20 forms the contour of the second ink container 26 to the position where the user can operate on the ink cartridge 2 from the outside of the ink cartridge installation part 10. Thus, the contour of the second ink container is deformed.

According to the this embodiment described above, since the operating member 29 of the empty ink cartridge 2 is opened toward the position where the user can operate on the ink cartridge 2 from the outside and the contour of the ink container 26 is deformed, it is possible for the user to easily visually identify the ink cartridge 2 needed to be removed. As a result, the user can easily and reliably replace the empty ink cartridge 2.

Further, since the joint part of the ink cartridge 2 is not separated from the joint part of the needle 32 of the tip end of the ink supplying tube 11 acting as the ink supplying path, problems such as leakage of the ink, and the mixing of air bubbles or dust into the ink supplying path are not caused.

Moreover, a special detection unit that detects the empty state of the ink cartridge 2 and an operating unit such as a special actuator like a solenoid that acts as a trigger for detecting the empty state of the ink and deforming the contour of the ink cartridge 2 are not required. As a result, the mechanism for identifying the ink cartridge 2 is simplified, which makes it possible for the user to easily and reliably replace the ink cartridge 2 with an inexpensive structure.

Next, a description is made of a second embodiment of the present invention.

Figure 5A:
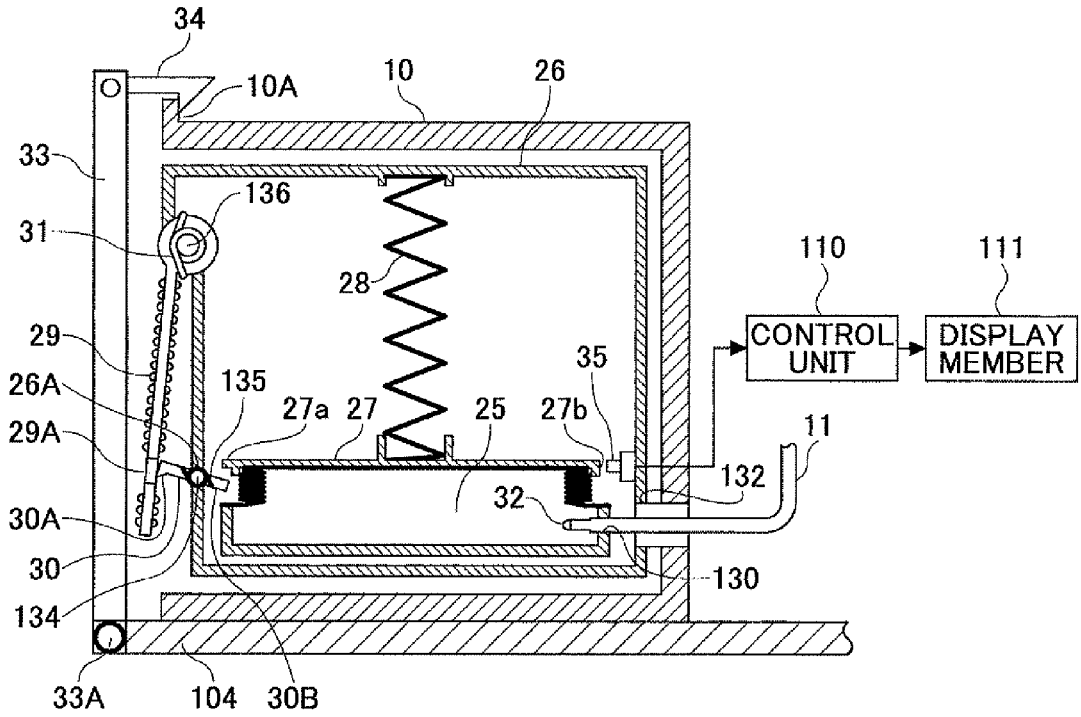
FIGS. 5A and 5B are views for explaining the configuration of the first and second ink containers used in the liquid droplet ejection apparatus according to a second embodiment of the present invention.
Figure 5B:
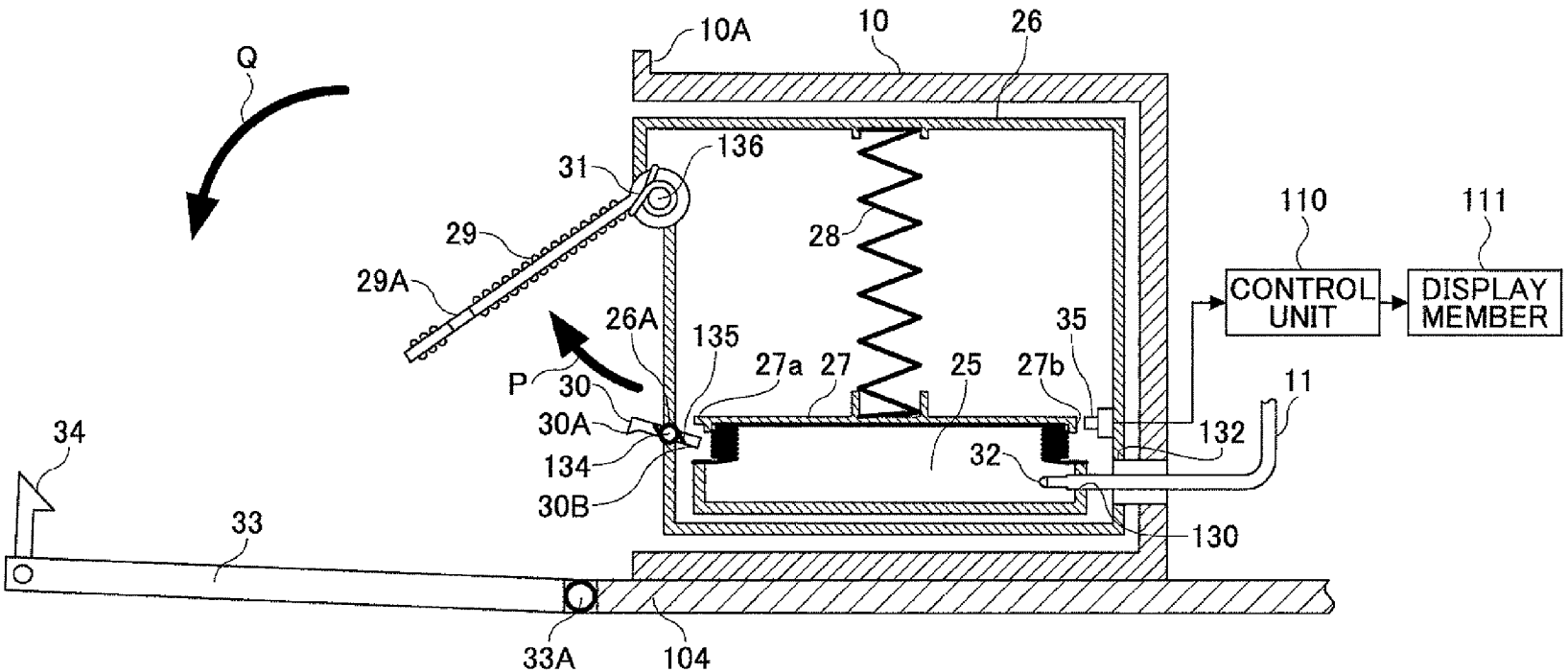

FIGS. 5A and 5B are based on a case where the opening/closing cover 33 shown in FIG. 1 is used. Note that in FIGS. 5A and 5B, components the same as those of the configuration of the first and second ink containers shown in FIGS. 4A and 4B are denoted by the same numerals.

The configuration of the first and second ink containers shown in FIGS. 5A and 5B is different from the configuration of the first and second ink containers shown in FIGS. 4A and 4B in that they have a mechanism for locking the opening/closing cover 33 and a mechanism for identifying and displaying the ink cartridge needing to be replaced.

In other words, the characteristic of this embodiment is that the state of the ink cartridge in which the remaining amount of the ink is below a prescribed value is detected by a detection member, the ink cartridge needing to be replaced is displayed on a display member, and the operating member 29 is opened to the outside simultaneously with the opening of the opening/closing cover 33 positioned at the front surface of the ink cartridge installation part 10 in which the ink cartridge needing to be replaced is installed. The configuration of the first and second ink containers of this embodiment is described below.

As shown in FIGS. 5A and 5B, the opening/closing cover 33 is swingablly supported on an ink container support part 104 provided at the bottom part of the ink cartridge installation part 10 with its lower side acting as a swing support point 33A.

The opening/closing cover 33 has, at its swing end, a locking member 34 formed of a swingable claw member whose base end is supported on the opening/closing cover 33. The locking member 34 is generally caused to have torque applied by a biasing member such as a torsion spring (not shown) in a direction where the locking member 34 engages a locking part 10A formed at the upper part of the ink cartridge installation part 10. Due to the torque, the locking member 34 engages the locking part 10A formed at the top surface of the ink cartridge installation part 10.

Further, at the position where the holding member 27, which moves simultaneously with the decrease of the volume of the first ink container 25, moves when the remaining amount of the ink is below a prescribed value, an optical senor 35 capable of detecting the movement position of the holding member 27 is arranged at the inner surface of the first ink container 25. The optical sensor 35 is a reflection-type optical sensor that uses an end surface 27*b* of the holding member 27 as a reflection surface. The optical sensor 35 is configured to detect the remaining amount of the ink inside the first ink container 25 by detecting light reflected by the end surface 27*b* when the end surface 27*b* of the holding member 27 opposes the optical sensor 35.

Although not shown in detail in FIGS. 5A and 5B, the optical sensor 35 is connected to the input side of a control unit 110 whose output side is connected to a display member 111 such as a lamp provided at the upper part of the front surface of the ink cartridge installation part 10 of the respective colors of the ink. The optical sensor 35 outputs a detection signal when the holding member 27 moves to the position where the remaining amount of the ink becomes zero.

After the reception of the signal from the optical sensor 35, the control unit 110 causes the display member 111 corresponding to the ink cartridge in which the remaining amount of the ink becomes zero to be lit so that the user can identify the ink cartridge needing to be replaced.

Further, as a method for detecting the state of the ink cartridge where the remaining amount of the ink becomes zero without the optical sensor 35, it may be possible to accumulate the dot count values of print data and report to the user the state of the ink container with the display member 111 when the accumulated dot count value reaches a value corresponding to the state where the remaining amount of the ink becomes zero with the consumption of the ink. Moreover, it is also possible to detect the turning amount of the engagement claw 30 provided in the holding member 27.

Meanwhile, due to its torque, the locking member 34 provided at the opening/closing cover 33 has an engagement force greater than the opening force of the operating member 29 provided at the second ink container 26, i.e., the turning force of the operating member 29 when the engagement of the operating part 29 with the engagement claw 30 is released to open the operating member 29 so that the user can operate on the ink cartridge from the outside. Thus, the opening of the operating member 29 is restricted by the opening/closing cover 33, and the opening of the operating member 29 for enabling the user to operate the ink cartridge from the outside is not allowed unless the engagement with the locking member 34 of the opening/closing cover 33 is released.

According to the this embodiment described above, when the remaining amount of the ink inside the first ink container 25 becomes zero, the state of the first ink container 25 is displayed on the display member 111 via the optical sensor 35 and the control unit 110.

After the identification of the ink cartridge needing to be replaced via the display member 111, the user releases the engagement with the locking member 34 to open the opening/closing cover 33 in a direction as indicated by arrow Q in FIG. 5B. Thus, the operating member 29 not previously allowed to be opened by the opening/closing cover 33 is opened so that the user can operate on the ink cartridge from the outside. Further, the user can also identify the ink cartridge needing to be replaced by confirming a change in the mode of the operating member 29.

Assuming that the user moves from a different location to a location where the ink jet printer 100 is installed so as to replace the ink cartridge, even if the opening/closing cover 33 is provided at the front surface of the ink cartridge installation part 10, the operating member 29 is opened so that the user can operate on the ink cartridge from the outside with the opening of the corresponding opening/closing cover 33. Therefore, the user can easily identify the ink cartridge needed to be removed. Since the operating member 29 is opened to the outside simultaneously with the opening of the opening/closing cover 33, the user is free from erroneously handling the ink cartridge needing to be replaced.

Next, a description is made of a third embodiment of the present invention.

Figure 6B:
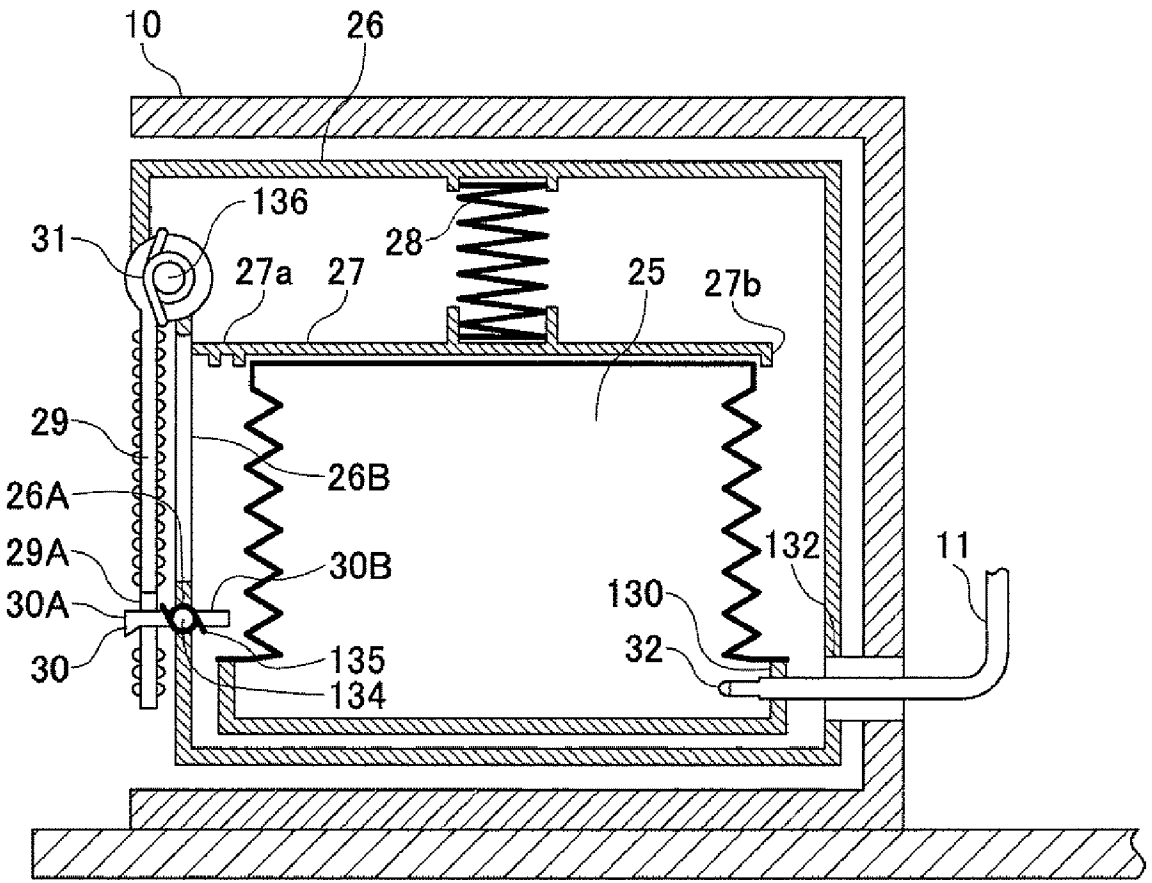
FIGS. 6A and 6B are views for explaining the configuration of the first and second ink containers used in the liquid droplet ejection apparatus according to a third embodiment of the present invention.
Figure 6A:
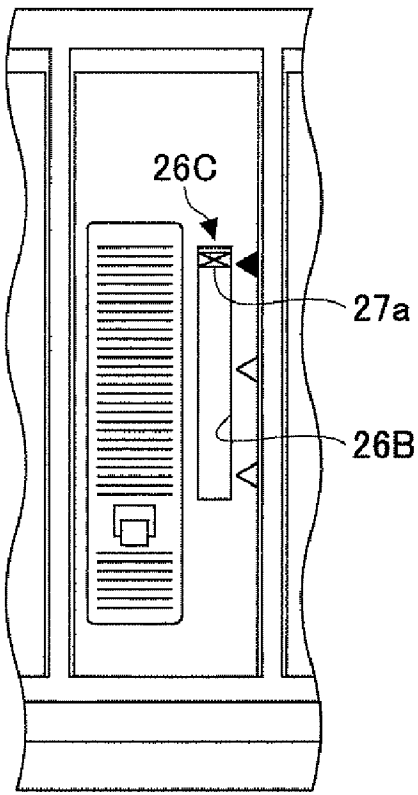

The characteristic of this embodiment shown in FIGS. 6A and 6B is that a configuration which enables the display of the remaining amount of the ink by a part of the holding member 27 is provided based on the configuration of the first and second ink containers shown in FIGS. 4A and 4B.

In other words, in the wall part of the second ink container 26 on the side where the operating member 29 is provided, a rectangular elongated hole 26B is formed where a part of the operating part 27*a* of the holding member 27 can enter and slide in a vertical direction.

At the front of the wall surface where the rectangular elongated hole 26B is formed, a display member 26C that displays the remaining amount of the ink with the movement of the operating part 27*a* of the holding member 27 is provided as shown in FIG. 6A.

According to this embodiment described above, the user can identify the position of the holding member 27 that moves simultaneously with the decrease of the volume of the first ink container 25 through the display member 26C. Therefore, it is possible for the user not only to confirm the remaining amount of the ink but also to identify the ink cartridge needing to be replaced based on the information of the remaining amount of the ink corresponding to a position in the elongated hole 26B.

Next, a description is made of a fourth embodiment of the present invention.

The characteristic of this embodiment is that the configuration of the operating member 29 and the configuration of the second ink container 26 having the operating member 29 are changed with respect to the configuration of the first and second ink containers shown in FIGS. 4A and 4B, and an operation alerting unit that alerts the user to replace the cartridge with the opening of the operating member 29 is provided.

Figure 7B:
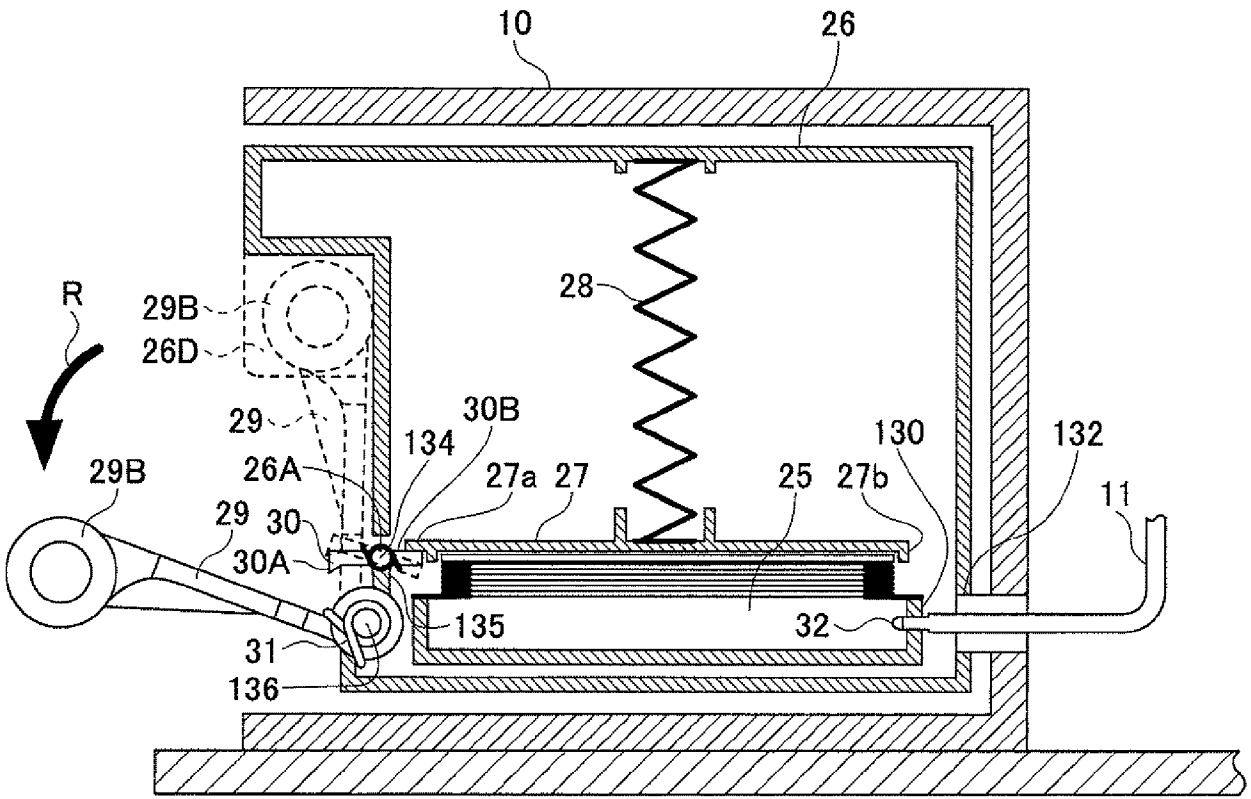
FIGS. 7A and 7B are views for explaining the configuration of the first and second ink containers used in the liquid droplet ejection apparatus according to a fourth embodiment of the present invention.
Figure 7A:
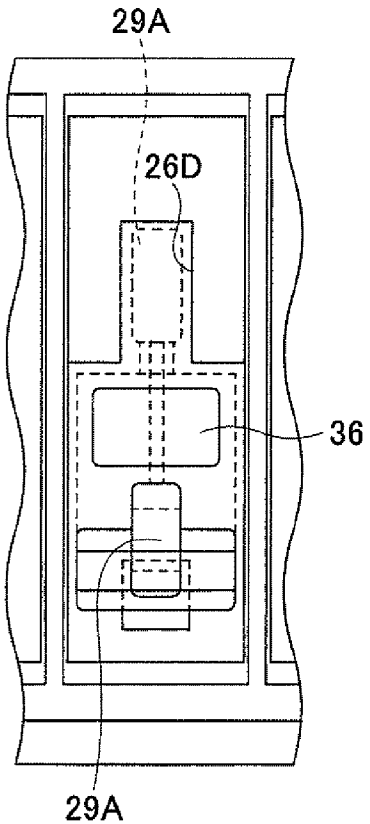

In other words, different from the operating member 29 with its upper side acting as the swing support point shown in FIGS. 4A and 4B, the operating member 29 shown in FIGS. 7A and 7B has a swing support point 136 on its lower side and is caused to be rotationally biased in a direction as indicated by arrow R, i.e., in a direction where the operating member 29 is opened, by the operating biasing unit 31. Further, the engagement claw 30 is also provided opposing the swing support point 136 of the operating member 29 as in the case of FIGS. 4A and 4B.

As shown in FIG. 7B, a swing end 29B of the operating member 29 is set to be greater than other parts and formed into a circular shape so that the user can easily use his/her fingers or the like to extract the operating member 29. At the wall part of the second ink container 26, a groove part 26D having a width allowing the user to insert the circular swing end 29B is formed.

When the remaining amount of the ink inside the first ink container 25 is not below a prescribed value, i.e., when the remaining amount of the ink does not become zero, the holding member 27 is not placed at a position where the engagement claw 30 is operated. In this case, as shown by chain double-dashed lines in FIG. 7B, the operating member 29 is inside the groove part 26D formed on the side of the second ink container 26 and forms a part of the contour of the second ink container 26.

Further, as shown in FIG. 7A, the operation alerting unit 36 expressed by a label, an inscription, or the like is provided at the wall part of the second ink container 26 having the groove part 26D so as to be visually checked by the user.

The operation alerting unit 36 is a member with which the user can understand the opening state of the operating member 29 when the operating member 29 is opened so that the user can operate the operating member 29 from the outside, and expressed by characters such as "OUT OF INK. PLEASE REPLACE CARTRIDGE." The opening state may be expressed by foreign languages, picture languages, or the like.

According to the this embodiment described above, the swing end 29B of the operating member 29 remains at the groove part 26D on the side of the second ink container 26 until the remaining amount of the ink inside the first ink container 25 is below a prescribed value, i.e., the remaining amount of the ink becomes zero. Thus, the user is prevented from carelessly operating the swing end 29B.

On the other hand, when the remaining amount of the ink inside the first ink container 25 becomes zero, the holding member 27 operates the engagement claw 30 to release the engagement of the engagement claw 30 with the operating member 29. Thus, the operating member 29 is opened to a position, where the user can operate the operating member 29 from the outside, due to its applied torque, and the circular part of the swing end 29B swings to the open position.

When the operating member 29 is opened, the user can visually check the operation alerting unit 36 provided at the wall part on the side of the second ink container 26. Thus, since the user can understand the meaning of the opening state of the operating member 29, he/she can pull and move the circular part of the swing end 29B of the operating member 29 and extract the ink cartridge needing to be replaced.

In this embodiment, the user cannot pull the operating member 29, which is capable of being opened to the outside in a protruding state and forms a part of the contour of the second ink container 26, until the remaining amount of the ink becomes zero. Therefore, the user can be reliably prevented from erroneously operating the operating member 29.

Further, in order to make use of such a function, the shape of the swing end 29B of the operating member 29 and the configuration of the wall surface on the side of the second ink container 26 where the swing end 29B opposes may be changed. For example, rather than being provided at the wall part, the operation alerting unit 36 may be provided at a front surface on the top side of the operating member 29 when the operating member 29 is opened. In this case, unlike the above case in which the operation alerting unit 36 is provided at the wall part set back far from the wall surface of the housing part of the second ink container 26, the operation alerting unit 36 is directly provided at the operating member 29 protruding to the outside. Therefore, the user can easily visually check the operation alerting unit 36.

Next, a description is made of a modification of the essential part of the configuration of the first and second ink containers shown in FIGS. 5A and 5B.

Figure 8A:
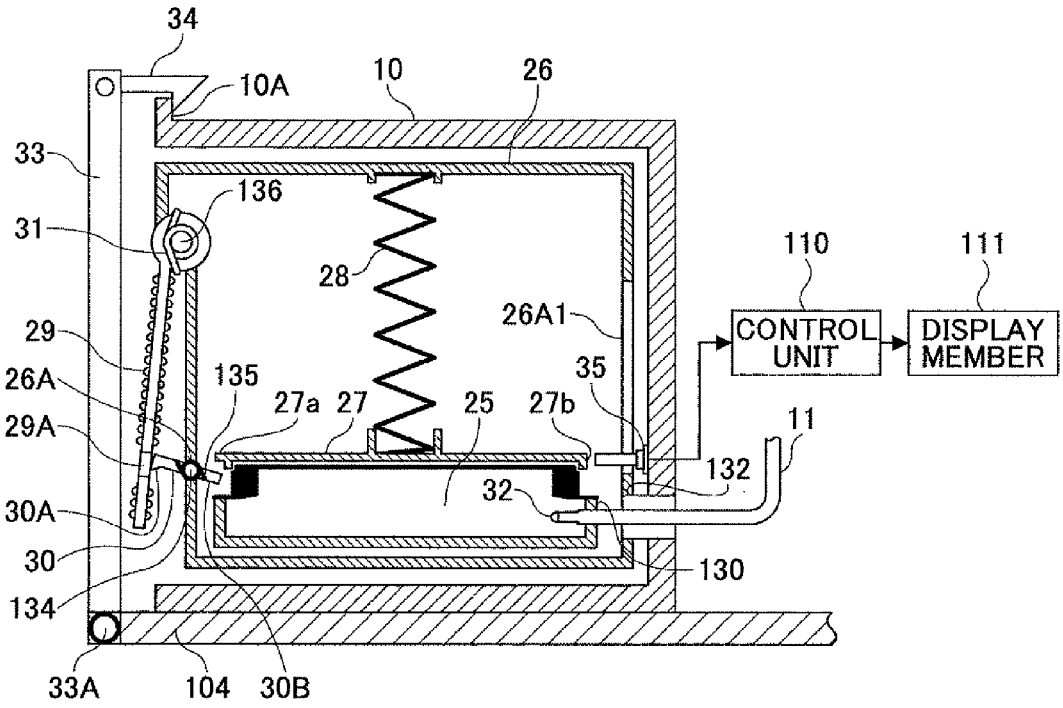
FIGS. 8A and 8B are views showing a modification of the configuration of the first and second ink containers shown in FIGS. 5A and 5B.
Figure 8B:
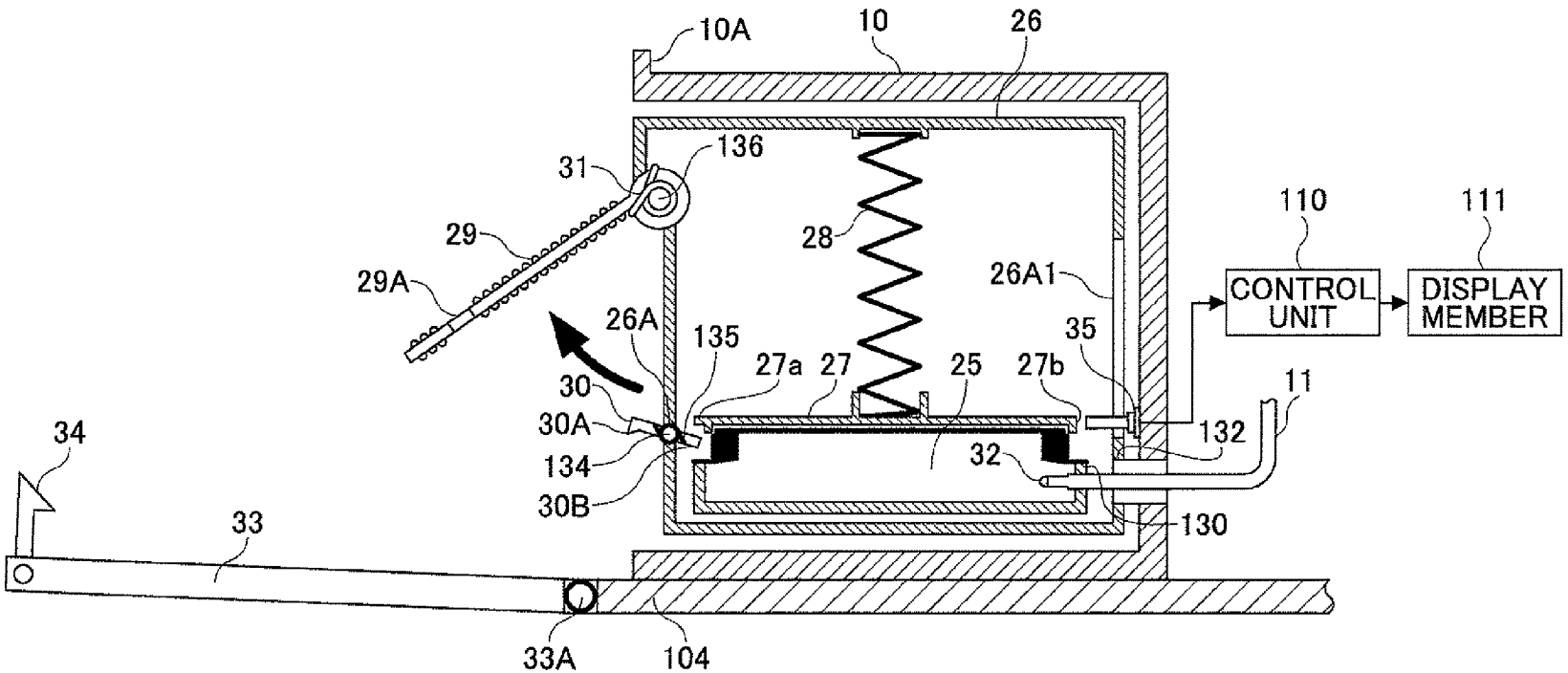

FIGS. 8A and 8B show a modification of the installation position of the optical sensor 35 shown in FIGS. 5A and 5B. In FIGS. 8A and 8B, the optical sensor 35 is provided outside the first ink container 25.

Meanwhile, in the wall part of the second ink container 26 on the side where the optical sensor 35 is arranged, a slit 26A1 having a longitudinal direction is formed in which the end part 27*b* extending from the holding member 27 can enter and move to a position corresponding to the state where the remaining amount of the ink becomes zero.

In this case, when the end part 27*b* of the holding member 27 moves to the position corresponding to the state where the remaining amount of the ink becomes zero with the consumption of the ink inside the first ink container 25, the end part 27*b* opposes the optical sensor 35. Therefore, the user can identify that the remaining amount of the ink becomes zero. According to this modification described above, since the optical sensor 35 is not required to be arranged in the limited space of the second ink container 26, it is possible to increase the volume of the first ink container 25 and boost stockpiles of the ink.

Next, a description is made of a fifth embodiment of the present invention.

The characteristic of this embodiment is that a mechanism for blocking the restoration of the shape of the first ink container 25 whose volume has decreased to the extent that the remaining amount of the ink becomes zero.

Figure 9A:
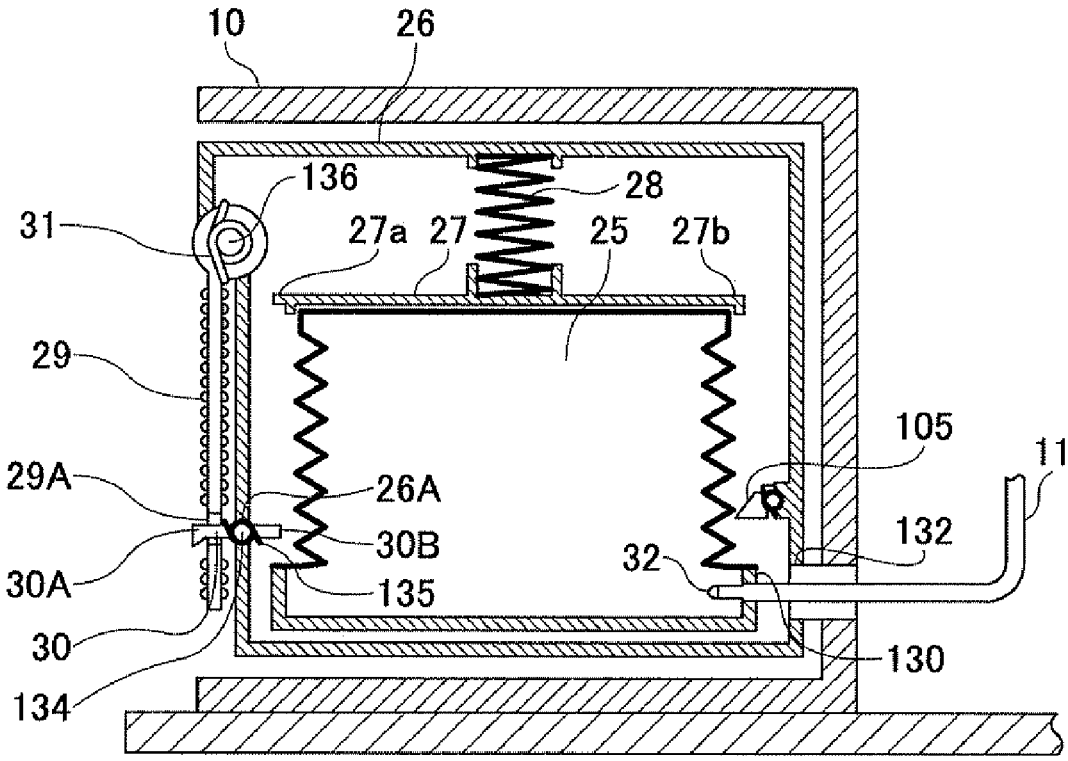
FIGS. 9A and 9B are views for explaining the configuration of the first and second ink containers used in the liquid droplet ejection apparatus according to a fifth embodiment of the present invention.
Figure 9B:
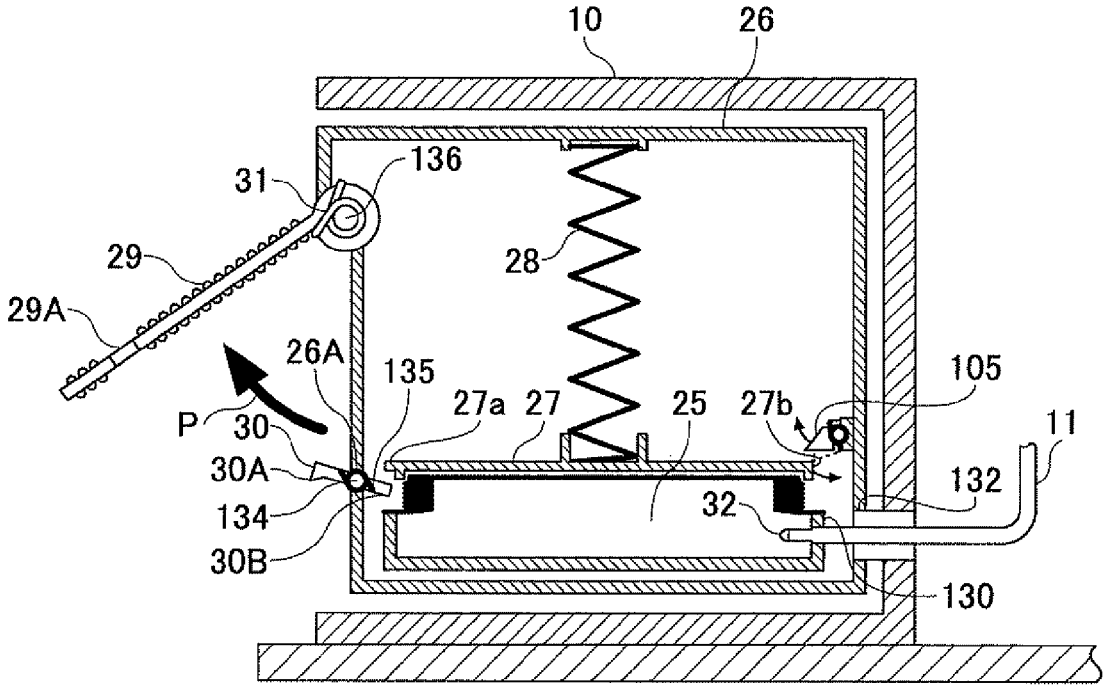

FIGS. 9A and 9B are views for explaining this characteristic with respect to the configuration of the first and second ink containers shown in FIGS. 4A and 4B. In FIGS. 9A and 9B, at the inner surface of the second ink container 26, a shape restoration blocking mechanism 105 using a ratchet mechanism is provided opposing an end surface 27*b* of the holding member 27.

With the ratchet mechanism, the shape restoration blocking mechanism 105 is caused to swing by a biasing unit such as a torsion spring and allows the movement of the holding member 27 when the holding member 27 is lowered and interferes with the shape restoration blocking mechanism 105. Further, the shape restoration blocking mechanism 105 restricts the upward movement of the holding member 27 which has passed through the shape restoration blocking mechanism 105. The lower surface of one downwardly protruding part at the end surface 27*b* of the holding member 27, which interferes with the shape restoration blocking mechanism 105, is formed to be inclined.

According to the embodiment described above, in the first ink container 25 whose volume has decreased to the extent that the remaining amount of the ink becomes zero, the holding member 27 that is lowered with the decrease of the volume of the first ink container 25 interferes with the shape restoration blocking mechanism 105 to rotate the ratchet.

After the holding member 27 passes through the shape restoration blocking mechanism 105 and the interference of the shape restoration blocking mechanism 105 with the holding member 27 is released, the shape restoration blocking mechanism 105 is restored to a state where it locks the holding member 27 due to its structure.

Thus, since the shape of the first ink container 25 is not carelessly restored, the intrusion of air bubbles and foreign matter due to the suctioning of air via nozzles caused when the shape of the first ink container 25 is restored can be prevented. The first ink container 25, which does not allow the intrusion of air bubbles and foreign matter, can be reused as an ink container rather than being discarded after extraction from the ink cartridge.

Next, a description is made of a sixth embodiment of the present invention.

The characteristic of this embodiment is that the supplying tube 11 in communication with the first ink container 25 is interrupted to prevent air bubbles and foreign matter from intruding into the first ink cartridge 25.

Figure 10A:
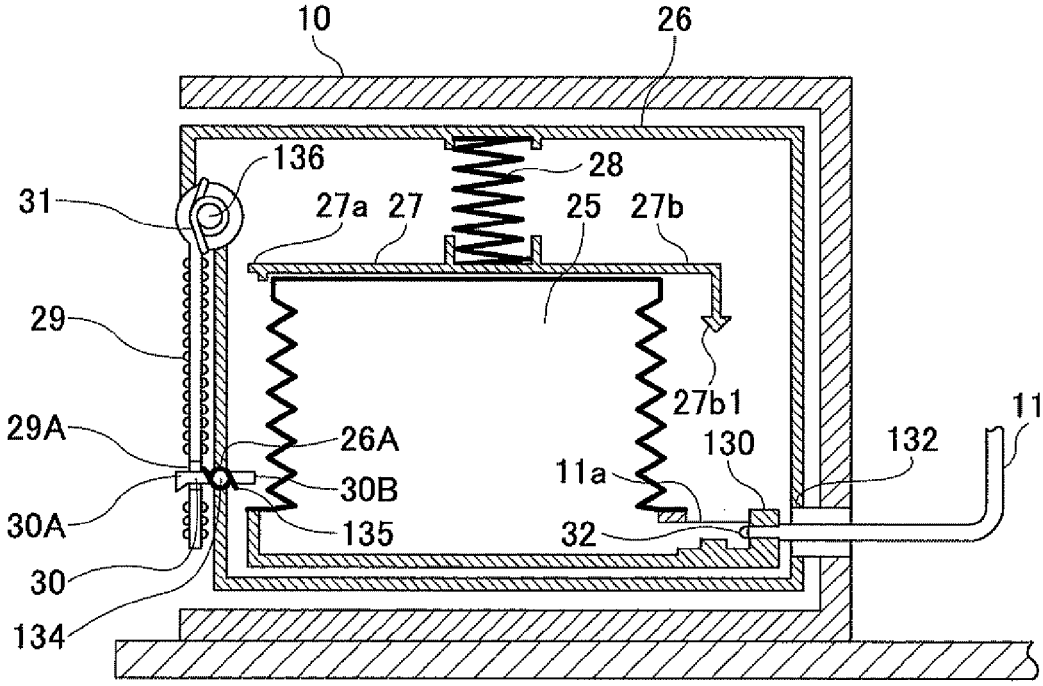
FIGS. 10A and 10B are views for explaining the configuration of the first and second ink containers used in the liquid droplet ejection apparatus according to a sixth embodiment of the present invention.
Figure 10B:
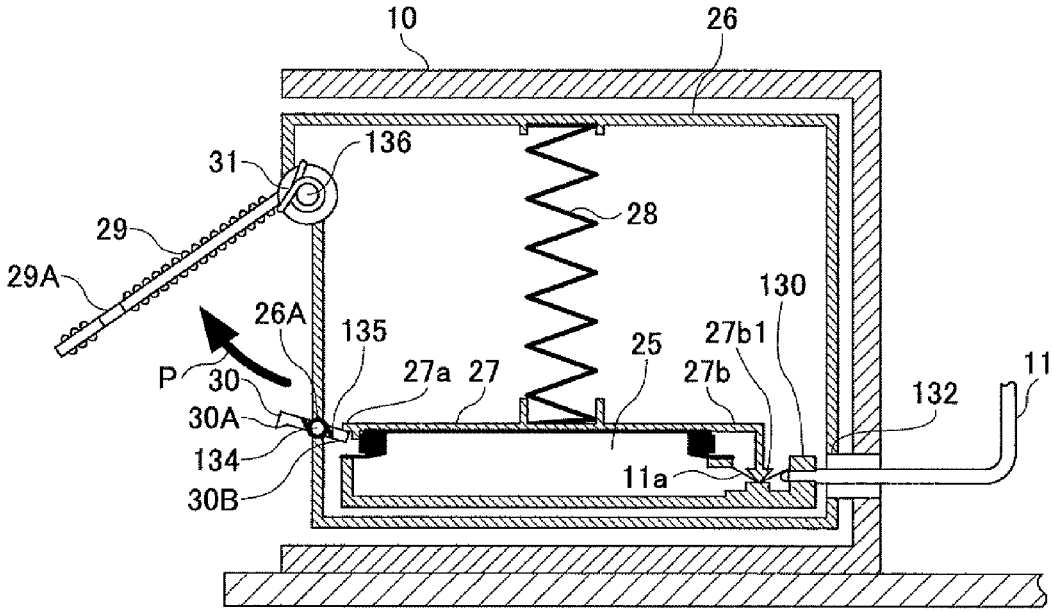

FIGS. 10A and 10B are views for explaining this embodiment with respect to the configuration of the first and second ink containers shown in FIGS. 4A and 4B. In FIGS. 10A and 10B, at the end part 27*b* of the holding member 27 that moves with the decrease of the volume of the first ink container 25, an interruption member 27*b*1 is provided that is configured to squeeze and interrupt a part of a flow path (denoted by numeral 11*a* for convenience sake) connecting the inside of the first ink container 25 to the ink supplying tube 11.

The flow path 11*a* interrupted by the interruption member 27*b*1 has flexibility so that it is easily squeezed. Thus, when the volume of the first ink container 25 decreases with the consumption of the ink and the holding member 27 is lowered to the position corresponding to the state where the remaining amount of the ink is below a prescribed value, the flow path 11*a* that connects the inside of the first ink container 25 to the ink supplying tube 11 is squeezed by the interruption member 27*b*1. As a result, the flow path of the ink, which connects the inside of the first ink container 25 to the head, is interrupted.

In this embodiment, it is possible to prevent air bubbles and foreign matter from intruding into the first ink container 25 only by squeezing a part of the ink supplying tube 11 and interrupting the flow path of the ink. The principle of this configuration is disclosed in Patent Document JP-A-2008-119969 as a prior application of this applicant.

According to the embodiments described above, when using the displacement of the holding member 27 due to the decrease of the volume of the first ink container 25 so as to identify the ink cartridge needing to be replaced, the user confirms only a change in the mode of the operating member 29 used to extract the ink cartridge rather than moving the ink cartridge itself. Therefore, there is no need to provide a mechanism that requires the generation of large load resistance used, for example, to move the ink cartridge and an increase in a driving force used to move the ink cartridge against the load resistance.

Thus, the user can identify the ink cartridge needing to be replaced with the simple configuration.

Moreover, since the ink cartridge can be free from the intrusion of air and foreign matter while maintaining a state where the remaining amount of the ink inside the first ink container 25 is below a prescribed value, it is possible to eliminate air bubbles and foreign matter from intruding the ink cartridge when the ink cartridge is reused.

The present invention is not limited to the specifically disclosed embodiments, and variations and modifications may be made without departing from the scope of the present invention.

The present application is based on Japanese Priority Application No. 2010-050708 filed on Mar. 8, 2010, the entire contents of which are hereby incorporated herein by reference.

What is claimed is:

1. A liquid supplying apparatus comprising:

a replaceable ink cartridge used as a main tank storing ink as a recording liquid;

a sub-tank to which the ink cartridge is connected via a supplying path and the ink inside the ink cartridge is supplied;

nozzles from which the recording liquid stored in the sub-tank is ejected; and an ink cartridge installation part detachably accommodating the ink cartridge, the ink cartridge having a first ink container that stores the ink and freely increases and decreases a volume thereof in accordance with a storing amount of the ink and a second ink container enclosing the first ink container, the first ink container having a holding member having a position thereof lowered in accordance with a remaining amount of the ink, the second ink container having an ink cartridge replacement operating member capable of being opened in a direction so as to outwardly protrude from a position adjacent to a side wall of the second ink container to a position allowing an operation on the ink cartridge from an outside of the ink cartridge installation part, a biasing unit that biases the operating member in the direction where the operating member is opened, and a locking unit that is provided at the side wall of the second ink container and fixes the operating member at the position adjacent to the side wall of the second ink container against the biasing unit, the locking unit engaging the operating member until the remaining amount of the ink inside the first ink container is below a prescribed value and the holding member engages the locking unit, the locking unit releasing engagement of the operating member when the remaining amount of the ink inside the first ink container is below the prescribed value and the holding member engages the locking unit, the operating member protruding from the ink cartridge installation part and being opened to the position allowing the operation on the ink cartridge from the outside when the engagement with the locking unit is released.

2. The liquid supplying apparatus according to claim 1, wherein the locking unit comprises an engagement claw swingably supported on the first ink container, the operating member comprises a wall surface member swingably supported on an contour of the second ink container, and the engagement with the operating member is released as the engagement claw is pushed by the holding member when the remaining amount of the ink inside the first ink container is below the prescribed value.

3. The liquid supplying apparatus according to claim 1, wherein the first and second ink containers comprise plural ink containers, an opening/closing cover supported on an ink container support part in a manner capable of being opened and closed is provided outside the second ink container, and the opening/closing cover is set to have a force required to maintain a closed state thereof greater than a force required to open the operating member to the position allowing the operation on the ink cartridge from the outside when the engagement with the locking unit is released.

4. The liquid supplying apparatus according to claim 1, wherein a part of the holding member is used as a display unit allowing identification of a state where the remaining amount of the ink inside the first ink container is shifted to the prescribed value.

5. The liquid supplying apparatus according to claim 1, wherein the second ink container having the operating member has an operation alerting unit that alerts replacement of the ink cartridge when the operating member is displaced to the position allowing the operation on the ink cartridge from the outside.

6. The liquid supplying apparatus according to claim 1, wherein the first ink container has a shape restoration blocking mechanism that maintains the first ink container at a position where the remaining amount of the ink is below the prescribed value.

7. The liquid supplying apparatus according to claim 1, wherein the first ink container has a mechanism that interrupts a flow path connecting the first ink container to the supplying path at a position where the remaining amount of the ink is below the prescribed value.

8. An image forming apparatus using the liquid supplying apparatus according to claim 1.

* * * * *